US005380002A

United States Patent [19]

Spector

[11] Patent Number: 5,380,002

[45] Date of Patent: * Jan. 10, 1995

[54] VARIABLE-WEIGHT PLAY PIECES

[76] Inventor: Donald Spector, 380 Mountain Rd., Union City, N.J. 07087

[ * ] Notice: The portion of the term of this patent subsequent to Aug. 9, 2011 has been disclaimed.

[21] Appl. No.: 989,353

[22] Filed: Dec. 11, 1992

Related U.S. Application Data

[63] Continuation-in-part of Ser. No. 743,279, Aug. 9, 1991, Pat. No. 5,335,907.

[51] Int. Cl.[6] ..... A63B 37/06; A63B 37/08; A63B 59/00

[52] U.S. Cl. ..... 273/58 H; 273/67 R; 273/72 R; 273/DIG. 8; 273/DIG. 20

[58] Field of Search ..... 273/58 R, 58 B, 58 BA, 273/58 H, 58 J, 58 A, DIG. 8, DIG. 20, 26 B, 72 R, 67 R

[56] References Cited

U.S. PATENT DOCUMENTS

| | | | |
|---|---|---|---|
| 4,212,460 | 7/1980 | Kraft | 273/58 B |
| 4,463,951 | 8/1984 | Kumasaka et al. | 273/58 BA X |
| 4,660,834 | 4/1987 | Carrigan | 273/58 B X |
| 4,738,450 | 4/1988 | Wexler | 273/58 A |
| 4,772,020 | 9/1988 | Martin | 273/65 EG X |
| 4,834,382 | 5/1989 | Spector | 273/65 EG |
| 4,919,422 | 4/1990 | Ma | 273/65 EG X |
| 4,952,190 | 8/1990 | Tarnoff et al. | 273/58 H X |
| 5,035,425 | 7/1991 | Edwards | 273/58 J X |
| 5,035,426 | 7/1991 | Spector | 273/65 EG X |
| 5,138,721 | 8/1992 | Spector | 2/267 |

FOREIGN PATENT DOCUMENTS

| | | | |
|---|---|---|---|
| 390690 | 4/1933 | United Kingdom | 273/65 EC |

*Primary Examiner*—William H. Grieb
*Attorney, Agent, or Firm*—Michael Ebert

[57] ABSTRACT

A variable-weight play piece, such as a ball or bat, the weight of the piece depending on the amount of water dispersed within a compressible internal body confined within a water-impermeable outer casing. The casing, whose shape is determined by the nature of the piece, is provided with a port having a removable closure, at least one section of the casing being flexible so that when manually pressed in, it acts to compress the internal body, and when pressure is released, the body then resumes its original shape which conforms to that of the casing. The internal body is formed of open-cell, flexible foam material having sponge-like properties. To impart heft to the play piece, the port is opened and pressure is applied to the flexible section of the casing to compress the internal body and thereby expel air therefrom through the open port. The pressure is then released to cause water introduced through the port to be drawn into and absorbed by the body, the port then being closed to retain the water in the play piece. To thereafter reduce the weight of the play piece, the port is opened and the internal body compressed to expel water therefrom through the open port.

8 Claims, 1 Drawing Sheet

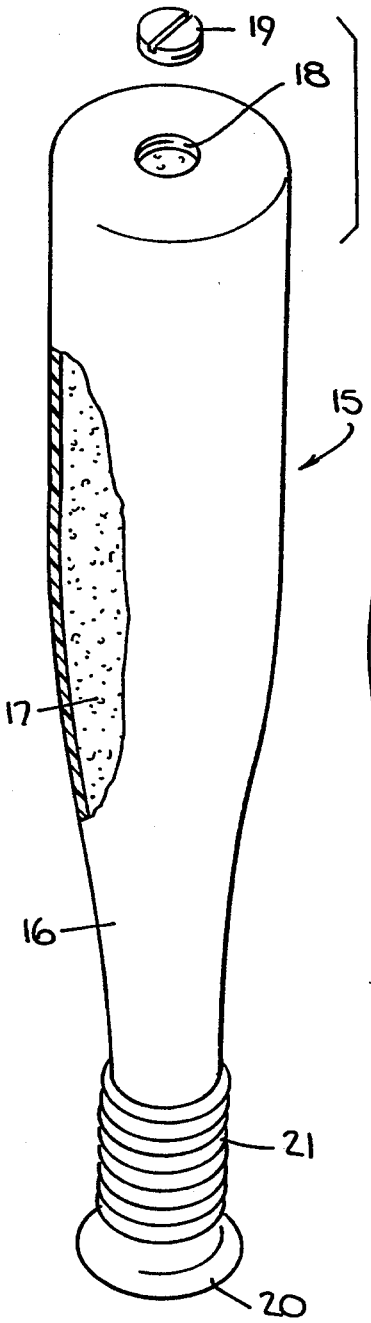
Fig. 3.
Fig. 1.
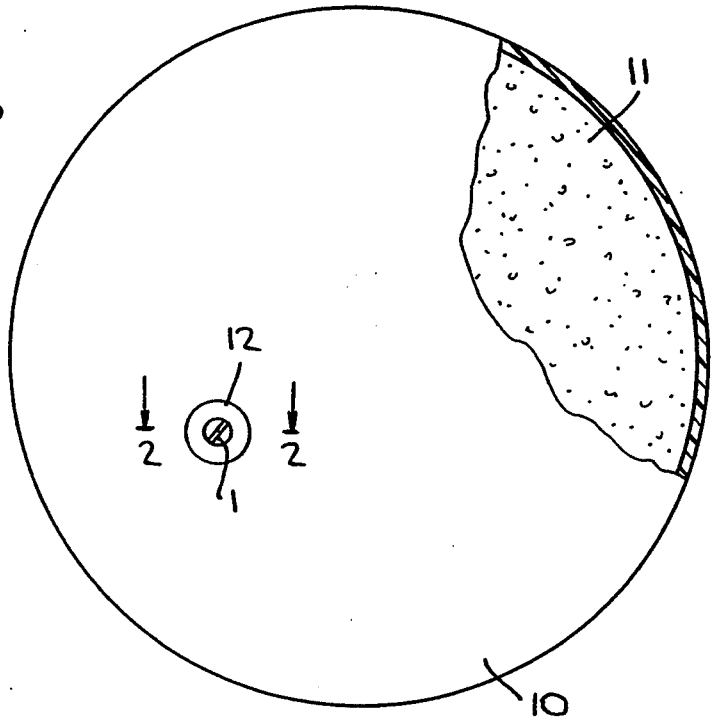
Fig. 2.
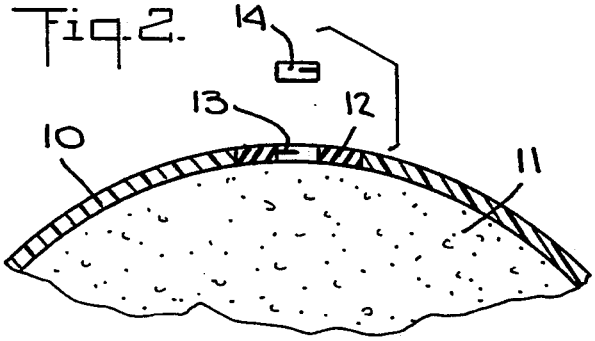

VARIABLE-WEIGHT PLAY PIECES

RELATED APPLICATION

This application is a continuation-in-part of my copending application Ser. No. 743,279, filed Aug. 9, 1991, entitled "Variable-Weight Play Ball", now U.S. Pat. No. 5,335,907, the entire disclosure of which is incorporated herein by reference.

BACKGROUND OF INVENTION

1. Field of Invention

This invention relates generally to play pieces, such as balls and bats, and more particularly to a variable-weight play piece having an encased sponge-like body within which water is dispersed to impart a desired degree of heft to the piece.

2. Status of Prior Art

A standard football is of oval shape and is made of an inflatable, high strength inner bladder and an outer casing formed of heavy leather, rubber or flexible plastic material. The bladder is provided with a valve so that it can be inflated with air, the valve automatically closing to retain the air in the bladder. Made in a similar fashion are spherical soccer balls, volley balls and basketballs. In these standard balls, the bladder is molded to assume, when inflated, the shape shape as the outer casing.

In the process of play, standard sports play balls of the pneumatic type are tossed, kicked and bounced, the balls being capable of withstanding very rough handling. While such balls are not regarded by adults as unduly heavy, they represent an intolerable load to a young child. Moreover, a standard inflatable athletic ball tends to produce a "hand sting." This effect arises when the ball, which has a hard casing, is caught by the bare hands while moving at high velocity.

While small children are attracted to conventional athletic balls and enjoy watching adults play soccer, football and other ball games, in the hands of a small child these athletic balls are heavy and dangerous, especially in indoor play. The standard inflated athletic ball has a relatively large diameter and a smooth, hard outer casing which makes it very difficult for a small child to grasp, throw and catch.

The toy and game industry has long recognized the need for lighter, softer and potentially less dangerous balls for young children. Balls in various shapes and sizes are now commercially available which are molded of polyurethane foam material and other light-weight, compressible plastics. Thus, the patent to Martin, 4,772,020, discloses a football intended for children in the form of a one-piece, molded, elliptical body constituted by soft, light-weight elastomeric foam material, such as polyurethane foam. And the patent to Ma, 4,919,422, discloses a spherical ball of baseball size formed of flexible, foam plastic material.

Light-weight balls made of flexible, foam plastic material, though much softer in the hands of children than the regulation balls they imitate, are incapable of withstanding rough handling. Thus, a foam plastic spherical ball having a diameter equivalent to that of a regulation soccer ball, though it can be thrown and bounced, cannot long survive being vigorously kicked by players.

My prior patent 4,834,382 discloses a pneumatic play ball that includes an outer casing of non-stretchable fabric material having a closable port therein, the configuration of the casing depending on the nature of the ball. The casing encases an ordinary balloon of stretchable material which when unconfined is capable of being inflated to assume a generally globular form, the balloon having an air-passage stem. In its uninflated state, the balloon is inserted into the casing through the port, the stem then projecting out of the port.

After the confined balloon is inflated by blowing air through its stem to cause the balloon to conform to the inner surface of the casing and to assume the same configuration, the stem is knotted to seal the balloon. The knotted stem is pushed under the opening, which is then closed, whereby no portion of the encased balloon can be extruded from the casing when the ball bounces.

As pointed out in my prior patent 4,035,426, a fabric-encased balloon, while not nearly as heavy as a leather encased conventional pneumatic ball, has sufficient weight to permit easy throwing without, however, inflicting injury should the ball hit a child. However, in some circumstances, the ball may be too light to permit play. Thus, on a windy beach, wind gusts will often deflect the fabric-encased balloon and interfere with play activity. In order, therefore, to give grater weight to the ball, this patent suggests that this can be done by wetting the outer fabric casing.

Wetting the fabric will add some weight to the ball, but since the fabric of the outer casing is exposed, it will not remain wet for long because of evaporation from this surface. Moreover, as it is only the outer surface of the ball that is water laden, the amount of weight added to the ball may not be sufficient to certain types of play activity.

Where the ball is of basketball size or greater and is to be tossed about in the fashion of a medicine ball, it is then desirable that the ball have considerable heft. Or where the ball is of soccer ball size and is to be played with by older children, it is desirable that its weight be closer to that of a regulation soccer ball, so that when kicked it will behave like a regulation ball. These ends cannot be achieved without my prior pneumatic encased balloon ball, which is inherently light in weight.

My related copending application Ser. No. 743,279 discloses a variable weight play ball whose weight is determined by the user. This ball includes an outer casing formed of liquid-impervious, flexible material having a configuration that depends on the nature of the playball. Confined within this casing is a low-density compressible body of the same configuration as that of the casing, the body being formed of flexible, foam plastic material having sponge-like characteristics.

A closable port formed in the casing provides access to the body encased therein. When the port is open and the ball is squeezed by the user to expel air therefrom, water fed into the port is absorbed by the body as the ball resumes its normal configuration to impart heft to the ball. The port is then closed to retain the water, so that the playball is in condition for play. Should it be thereafter necessary to lighten the ball, the port may then be opened and the ball squeezed to extrude water from the body until the ball has the desired reduced weight.

A variable-weight play ball of the type disclosed in my copending application Ser. No. 743,279 is effective for its intended purpose. However, it is difficult to manufacture. In the manufacturing process, use is made of the ball-shaped fabric casing in its collapsed state. When molten plastic material is fed into the open port of this casing, it acts to inflate the casing, and when the plastic material is cooled and cured, it creates a foam plastic body within the confines of the inflated casing. But in order to blow up the casing with the molten material injected therein, a relatively high pressure is required. The necessary pressure level is difficult to attain.

Moreover, the fabric casing of a variable-weight ball of this type is not strong. When, therefore, the ball is weighted by water impregnating its sponge-like internal body, the casing may be ruptured when the ball strikes a hard surface, or is vigorously kicked or hit by a bat.

Also of prior art interest is my patent 5,071,123 (1991) which discloses a hollow baseball bat for children, the bat being blow-molded of synthetic plastic material and being, therefore, much lighter in weight than a standard wood bat. The present invention provides a similar bat, but one whose weight is variable, so that its user can impart to the bat a weight that suits his needs.

SUMMARY OF INVENTION

In view of the foregoing, the main object of this invention is to provide a variable-weight play piece, such as a ball or bat, having confined within an outer casing an internal body formed of low-density, open-cell, flexible foam plastic material which is more or less impregnated with water to impart weight to the play piece.

A significant advantage of a ball or bat in accordance with the invention is that a large percentage of its low-density, foam-plastic internal body is constituted by air; hence the ball or bat in its initial state is quite light and can easily be handled by a young child. However, by adding water to the body which is absorbed thereby, the heft of the ball or bat may be increased to a desired degree.

More particularly, an object of this invention is to provide a play ball or bat of the above type whose outer casing is liquid-impervious and includes a small closable port, and whose foam plastic internal body has sponge-like characteristics whereby water can be introduced into the body through its open port and adsorbed thereto to impart heft to the body, the water being thereafter extrudable through the port to reduce the water content of the body and thereby lighten the ball or bat.

Also an object of this invention is to provide a durable, high-strength ball or bat of the above type which may be manufactured at low cost.

Briefly stated these objects are attained in a variable-weight play piece, such as a ball, a bat, a golf club or other hand-held implement adapted to strike a ball. The weight of the piece depends on the amount of water dispersed within a compressible internal body confined within a water-impermeable outer casing. The casing, whose shape is determined by the nature of the piece, is provided with a port having a removable closure, at least one section of the casing being flexible so that when manually pressed in, it acts to compress the internal body, and when pressure is released, the body then resumes its original shape which conforms to that of the casing.

The internal body is formed of open-cell, flexible foam material having sponge-like properties. To impart heft to the play piece, the port is opened and pressure is applied to the flexible section of the casing to compress the internal body and thereby expel air therefrom through the open port. The pressure is then released to cause water introduced through the port to be drawn into and absorbed by the body, the port then being closed to retain the water in the play piece. To thereafter reduce the weight of the play piece, the port is opened and the internal body compressed to expel water therefrom through the open port.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a preferred embodiment of a variable-weight play ball in accordance with the invention, the outer casing being partially cut away to expose the inner foam-plastic body of the ball;

FIG. 2 is a section taken in the plane indicated by line 2—2 in FIG. 1; and FIG. 3 shows a preferred embodiment of a variable-weight bat in accordance with the invention.

DESCRIPTION OF INVENTION

A variable-weight play piece in accordance with the invention may be a ball, a bat for striking a ball, a golf club, a hockey stick, or any other hand-held play piece usable by a child. While the invention will be disclosed herein as embodied in a ball and in a baseball bat, it is to be understood that the invention is applicable to other forms of play pieces.

The Ball

Referring now to FIG. 1, there is illustrated a variable-weight playball in accordance with the invention, the ball being spherical and having a diameter corresponding to that of a regulation basketball, a soccer ball or a baseball. In practice, the ball may have any desired shape and size, such as that of a football. In the embodiment shown, the ball is constituted by an outer casing 10 having a spherical shape within which is confined a compressible internal body 11 whose shape conforms to that of the casing so that no space exists therebetween.

Casing 10 is formed by a seamless skin of elastomeric, water-impermeable material such as rubber or neoprene of the type used in making air-filled rubber balls.

Sealed to the surface of casing 10 is a flexible disc 12 formed of thermoplastic material, such as polypropylene, provided at its center with a small port 13 that is internally threaded. As shown in FIG. 2, threadably received in port 13 is a removable, externally-threaded closure plug 14 to provide access to body 11 of the ball. Plug 14 is provided with a diametrical slot so that it can be turned in or out by a small coin or a screwdriver.

While a small port is necessary to the playball, the closure therefor need not be in the form of a screw-in plug, for in practice use may be made of a press-in plug or other closure means.

Body 11 is formed of low-density, open-cell, flexible foam plastic material which is highly compressible and has sponge-like characteristics. Foam plastics range in density from one tenth of a pound to 65 pounds per cubic foot, and range in consistency from rigid material suitable for structural applications, to flexible substances for soft cushions. And they range in cellular formation from open or interconnecting cells to the closed or unicell type. A preferred form of plastic material for body 11 is one in which gas is generated chemically during the reactions that take place in forming the open-cell plastic, such as polyurethane foam. In producing this foam, a polyester resin and an aromatic diisocyanate react to form a prepolymer which then reacts with water to form a urethane polymer. Because of the carbon dioxide generated in this reaction, its presence causes the urethane resin to assume an interconnected open cell foam.

Foam plastic body 11 is of a low density, preferably not exceeding one and one half pounds per cubic foot. Hence the ball, in its initial state, is relatively light in weight, for a large percentage of the body is constituted by the air which fills the cells.

In manufacturing this ball, the casing of elastomeric material is used as a mold for the foam plastic body which is created by feeding plastic material in its molten state into the interior of the casing through open port 13. Since the casing has the self-supporting form of a hollow ball, no pressure is required when feeding the plastic material into the casing, for there is no need to inflate the casing. When the molten mass is cooled and cured, the resultant internal body which conforms to the shape of the casing is constituted by flexible, open-cell foam plastic material having sponge-like properties.

In order to impart a desired degree of heft to the ball, water is added to its sponge-like internal body and absorbed thereby, the water being distributed throughout the body, so that it is properly balanced. To this end, plug 14 is removed to open port 13, and the ball is squeezed by hand to expel air out of the sponge-like body, the air being discharged through the open port. Water is then introduced through the port into the body, and as this is done, hand pressure on the ball is gradually released to create a negative pressure within the sponge-like body. This acts to soak up the water and to distribute it uniformly throughout the body. One adds as much water as is necessary to bring up the weight of the ball to the desired level, at which point the port is closed to retain the water within the ball.

Should a player later wish to somewhat lighten the playball, this is easily accomplished by again opening the port and squeezing the ball to extrude water from the sponge-like body out of the port until the ball attains the desired reduced weight.

When the playball is vigorously kicked or bounced, the shock is absorbed by the compressible internal body of the ball, but the shape of the ball is maintained by the elastomeric casing which permits indentation of the ball in the region at which the force is applied, but does not permit the ball to assume any shape than its predetermined spherical configuration. And because the ball has a casing of elastomeric material, it will not split open or rupture, even when struck a heavy blow.

The invention is by no means limited to balls having a spherical shape, for the ball may be in a football or any other format.

The Bat

Referring now to FIG. 3, there is shown a variable-weight bat 15 in accordance with the invention adapted to strike a baseball or any other type of ball. The outer casing 16 of the bat, which has a baseball bat shape, is blow or roto-molded of synthetic plastic material such as fiber-reinforced nylon or polypropylene, The resultant casing, while of relatively light weight, is of high strength and can survive rough handling.

Confined within casing 16 is an internal body 17 of compressible, open-cell, foam plastic material of the type previously disclosed in connection with the variable-weight ball. The bat is provided at its upper end with an internally threaded port 18 which is closable by a removable, externally-threaded closure plug 19. In manufacturing the bat, the molten plastic is introduced through port 18 into the hollow of the casing, the molten plastic, when cooled and cured, forming an internal foam plastic body whose shape conforms to that of the casing.

The upper cylindrical striking section of the casing has a relatively large diameter which is progressively reduced in the tapered intermediate section which merges with a handle section having a smaller diameter, the handle section terminating in a round knob 20.

Created by an array of corrugations in the handle section of the casing is a bellows 21, the plastic material of the casing in this region being sufficiently flexible so that the bellows is compressible, using knob 20 as the actuator for this purpose. The bellows provides a better gripping surface for the handle.

To add weight to the bat, port 18 is opened and bellows 21 is actuated to compress the internal sponge-like body 17, this action causing air to be expelled from the body through open port 18. Then as the bellows is released to resume its normal shape, water is introduced through open port 10, the water being sucked into the internal body. By repeatedly actuating the bellows, one can add as much water to the bat as is necessary to impart a desired weight thereto, after which the port is closed by plug 19.

To thereafter reduce the weight of the bat, the port is again opened and the bat is turned upside down. Each time the bellows is compressed, this causes water to be expelled from the internal body and discharged through open port 18. And each time the bellows is released, air is sucked into the internal body to replace the water expelled therefrom. After the weight has been reduced to the desired extent, the port is closed to retain the water dispersed within the bat.

When the internal body 17 of the bat is saturated with water, the bat is then quite heavy. Hence, when transporting the bat, it can be lightened by discharging the water therefrom. In practice, the foam plastic material has an antibacterial agent incorporated therein to prevent decay of the encased internal body.

The play piece may also take the form of a baby doll having an outer casing of rubber-like material which defines the head, arms, legs and torso of the doll, the casing being occupied by a compressible internal body of open-cell, flexible foam material of the type previously described. The internal body is impregnated with water, preferably using a squeezable baby bottle for this purpose having a nipple. The nipple is inserted in the open mouth of the doll, behind which is a self-closing slit formed in an elastic membrane through which air is expelled by squeezing the doll, water then being sucked into the internal body when the pressure is released. The doll is provided at its crotch with a one-way valve through which water is expelled when the water impregnated doll is squeezed to simulate a baby wetting action.

While there have been shown and described preferred embodiments of variable-weight play pieces in accordance with the invention, it will be appreciated that many changes and modifications may be made therein without, however, departing from the essential spirit thereof.

I claim:

1. A variable weight play piece whose weight depends on the amount of water dispersed therein comprising:

(a) an outer casing formed of water-impermeable material and having a shape determined by the nature of the piece, said casing being provided with a port having a removable closure, at least a section of the casing being flexible, whereby the section may be manually pressed in the section and resuming its original form when pressure is released;

(b) an internal compressible body within the confines of the casing and having the same shape, the body being formed of open-cell, flexible foam plastic material having sponge-like properties, whereby to add water to the piece and thereby increase its weight, the port is opened and the flexible section pressed in to expel air from the body through the port, water then introduced through the open port then being sucked into and absorbed by the body when pressure is released, the port then being closed to retain the water within the piece.

2. A play piece as set forth in claim 1, in which the piece is a ball, and the casing has the shape of the ball.

3. A play piece as set forth in claim 2, in which the casing is formed of elastomeric material.

4. A play piece as set forth in claim 3, in which the ball is spherical in shape.

5. A play piece as set forth in claim 1, in which the play piece is a baseball bat and said casing has the shape of a bat having an upper section of relatively large diameter and a handle section of smaller diameter.

6. A play piece as set forth in claim 5, in which the handle section is corrugated to define a flexible bellows.

7. A play piece as set forth in claim 6, in which the port is disposed at the top end of the casing.

8. A play piece as set forth in claim 7, having an actuating knob formed at the bottom end of the casing with which to manipulate the bellows.

* * * * *